US005627553A

United States Patent [19]

Poulton

[11] Patent Number: 5,627,553

[45] Date of Patent: May 6, 1997

[54] FOLDED LENS ANTENNA

[75] Inventor: Geoffery T. Poulton, Westleigh, Australia

[73] Assignee: Commonwealth Scientific and Industrial Research Organisation, Australia

[21] Appl. No.: 335,838

[22] PCT Filed: May 5, 1993

[86] PCT No.: PCT/AU93/00200

§ 371 Date: May 3, 1995

§ 102(e) Date: May 3, 1995

[87] PCT Pub. No.: WO93/22806

PCT Pub. Date: Nov. 11, 1993

[30] Foreign Application Priority Data

May 5, 1992 [AU] Australia ..... PL2277

[51] Int. Cl.[6] ..... H01Q 19/06

[52] U.S. Cl. ..... 343/754; 343/771; 333/21 A

[58] Field of Search ..... 343/754, 755, 343/756, 769, 771, 780, 909; 333/21 A, 248, 254

[56] References Cited

U.S. PATENT DOCUMENTS 3,827,055 7/1974 Bogner et al. ..... 343/754
4,819,003 4/1989 Goto et al. ..... 343/771
4,994,817 2/1991 Munson et al. ..... 343/770
5,049,895 9/1991 Ito et al. ..... 343/771

FOREIGN PATENT DOCUMENTS 0448806 2/1992 Japan .

OTHER PUBLICATIONS

G.T. Poulton and A.P. Whichello, I.R.E. Conf. International, Digest of Papers, 306–308, Sydney 5–9 Sep. 1983.

*Primary Examiner*—Donald T. Hajec
*Assistant Examiner*—Tan Ho
*Attorney, Agent, or Firm*—Dressler, Rockey, Milnamow & Katz, Ltd.

[57] ABSTRACT

A scanning folded lens antenna system for scanning reception and/or transmission of electromagnetic radiation and method of scanning receiving and/or transmitting electromagnetic energy. The folded lens has a first cylindrical parallel plate waveguide, a second cylindrical parallel plate waveguide, a waveguide coupler operatively associated with the first and second waveguides to communicate a signal therebetween so as to transform a cylindrical signal from the first waveguide to a substantially planar phase signal in the second waveguide, and a plurality of coupling device operatively associated with first waveguide for coupling a signal between the first waveguide and the coupling device.

20 Claims, 4 Drawing Sheets

FOLDED LENS ANTENNA

TECHNICAL FIELD

The present invention relates to folded lens transmit/receive antennae, systems for receiving and/or transmitting a signal, methods for receiving and/or transmitting electromagnetic energy, a scanning folded lens antenna, systems for scanning reception and/or transmission of electromagnetic radiation and methods of scanning receiving and/or transmitting electromagnetic energy are disclosed.

BACKGROUND ART

With the expansion of satellite communications and the development of various markets in that field, it has been a requirement recently for mobile satellite communication systems to be developed. Those systems currently in use comprise relatively expensive componentry and are typically beyond reach of the average consumer. Antenna requirements for mobile satellite communication systems are quite demanding and it has not been possible to produce an antenna capable of mobile satellite operation at a cost effective price. In the development of AUSSAT-B satellite system for Australia, it is anticipated that a mobile satellite communications antenna would retail at approximately AU$2000. Other requirements are that a suitable antenna should be of a size suitable for being readily fitted upon a vehicle roof. Also, due to low height being a requirement which implies the use of a planar radiator, an antenna used in the AUSSAT system is required to provide 12 dB of gain and must operate over the elevation range 30° to 70° with a full 360© azimuth coverage. Planar phased array technology can be used, and some development has proceeded in this direction, however, the high cost of phase shifting elements makes a required low cost design difficult.

OBJECTS OF THE INVENTION

It is an object of the present invention to provide folded lens transmit/receive antennae.

Other objects are to provide systems for receiving and/or transmitting a signal, methods for receiving and/or transmitting electromagnetic energy, a scanning folded lens antenna, systems for scanning reception and/or transmission of electromagnetic radiation and methods of scanning receiving and/or transmitting electromagnetic energy are disclosed.

DISCLOSURE OF THE INVENTION

In accordance with a broad embodiment of the present invention there is disclosed a folded lens transmit/receive antenna comprising:

a first parallel plate waveguide;

a second parallel plate waveguide;

a waveguide coupler operatively associated with the first and second waveguides to communicate a signal therebetween so as to transform a substantially curved signal comprising a wave having a substantially curved wave front from the first waveguide to a substantially planar signal comprising a wave having a substantially planar wave front in the second waveguide;

means for coupling a signal between the second waveguide and free space, the means for coupling being operatively associated with the second parallel plate waveguide; and a coupling device operatively associated with the first waveguide for coupling a signal between the first waveguide and the coupling device.

The first and second waveguides of the first embodiment are generally smooth closed curve waveguides. The plan geometry of the waveguides of the folded lens antenna of the first embodiment may be a curve in the class of smooth closed curves of which a circle (in which case the waveguide is a cylindrical waveguide) and ellipse are included. The first and second waveguides of the first embodiment may be the same type of waveguide (e.g both may be elliptical waveguides) or the first waveguide may be a different type of waveguide to the second waveguide (e.g. the first waveguide may be cylindrical and the second waveguide may be elliptical). Generally, the first and second waveguides are the same type of waveguide.

In accordance with a second embodiment of the present invention there is disclosed a folded lens transmit/receive antenna comprising:

a first cylindrical parallel plate waveguide;

a second cylindrical parallel plate waveguide;

a waveguide coupler operatively associated with the first and second waveguides to communicate a signal therebetween so as to transform a cylindrical signal comprising a wave having a cylindrical wave front from the first waveguide to a planar signal comprising a wave having a planar wave front in the second waveguide;

means for coupling a signal between the second waveguide and free space, the means for coupling being operatively associated with the second cylindrical parallel plate waveguide; and a coupling device operatively associated with the first waveguide for coupling a signal between the first waveguide and the coupling device.

Generally, the waveguide coupler is a waveguide bend which is disposed about the peripheries of the first and second waveguides. Generally, the waveguide coupler is a U-shaped or parabolic-shaped bend or other shaped bend (the shape of the waveguide bend can be determined using the analysis technique described in G. T. Poulton and A. P. Whichello, I.R.E. Conf. International, Digest of Papers, 306–308, Sydney 5–9 Sep. 1983 incorporated herein by cross reference) so that a cylindrical wave front in the first waveguide on striking the waveguide bend is transformed into a planar wave front and is directed by the bend into the second waveguide. In addition, a planar wave front in the second waveguide on striking the parabolic waveguide bend is transformed into a cylindrical wave front and is directed by the bend into the first waveguide.

Typically, the means for coupling is a transmit/receive plate comprising at least one plate of the second waveguide. Alternatively, the means for coupling may be a single aperture or a plurality of apertures in one of the parallel plates of the second waveguide.

In accordance with a third embodiment of the present invention there is disclosed a system for receiving an electromagnetic signal, the system comprising:

the folded lens transmit/receive antenna of the first or second embodiments for receiving a signal and outputting a received signal;

a receiver operatively associated with the coupler of the antenna for receiving the received signal.

Typically the receiver includes a filter and amplifier connected to the antenna to filter and amplify the received signal and a demodulator connected to the filter and amplifier for demodulating the received signal to provide an output information signal.

In accordance with a fourth embodiment of the present invention there is disclosed a system for transmitting electromagnetic energy, the system comprising:

the folded lens transmit/receive antenna of the first or second embodiments for transmitting an electromagnetic signal; and a transmitter operatively associated with the coupler to generate a curved signal in the first waveguide (in the case of the second embodiment a cylindrical signal in the first waveguide).

Generally, the transmitter of the fourth embodiment includes a microwave frequency generator, a modulator for mixing the microwave frequency with an input information signal to produce a modulated signal and a power amplifier for amplifying the modulated signal and outputting it to a transmit/receive antenna of the first or second embodiments for transmission of the modulation signal to free space.

In accordance with a fifth embodiment of the present invention, there is disclosed a system for transmitting and receiving electromagnetic energy, said system comprising:

a folded lens transmit/receive antenna of the first or second embodiments for receiving and transmitting an electromagnetic signal and outputting a received signal;

a receiver operatively associated with the coupling device; and a transmitter operatively associated with the coupling device to generate a curved signal in the first waveguide (in the case of the second embodiment a cylindrical signal in the first waveguide).

Generally, in the system of the fifth embodiment the antenna is coupled to a circulator, the circulator transferring energy received by the antenna to a filter, amplifier and receiver to provide an output information signal. The circulator also transfers energy from a frequency generator, modulator and power amplifier to the antenna for transmission of the modulated input information signal to free space.

In accordance with a sixth embodiment of the present invention there is disclosed a method for receiving electromagnetic energy, said method comprising the step of receiving the energy with a system of the third embodiment.

In accordance with a seventh embodiment of the present invention there is disclosed a method for transmitting electromagnetic energy, the method comprising applying an information input signal to the transmitter of the system of the fourth embodiment.

In accordance with an eighth embodiment of the present invention there is disclosed a method for transmitting and receiving electromagnetic energy, the method comprising:

applying an information input signal to the transmitter of the system of the fourth embodiment;

receiving the energy with a system of the fifth embodiment.

In accordance with a ninth embodiment of the present invention there is disclosed a scanning folded lens antenna comprising an antenna of the first embodiment having a plurality of coupling devices arranged about a smooth dosed curve reflector centrally or non-centrally disposed in the first waveguide to enable scanning of an antenna radiation pattern.

More particularly, there is disclosed a scanning folded lens antenna comprising an antenna of the second embodiment having a plurality of coupling devices arranged about a cylindrical reflector centrally or non-centrally disposed in the first waveguide to enable scanning of an antenna radiation pattern.

The plurality of coupling devices thus permits scanning of the antenna radiation pattern. Typically there are 2 to 60 coupling devices, more typically 4 to 16 coupling devices. The coupling devices may be arranged in either a symmetrical pattern around the reflector so that they are equispaced or they may be arranged in a non-symmetrical pattern in which case they are not equispaced around the reflector. Depending on the number of coupling devices the signal from the antenna may be scanned from through an azimuth beam width in the range 0° to 180°. Typically the beam is scanned through an azimuth beam width in the range 5° to 80°, more typically 20° to 55°. Generally the reflector is centrally located in the first waveguide.

In accordance with a tenth embodiment of the present invention there is disclosed a system for scanning reception of electromagnetic radiation, the system comprising:

an antenna of the ninth embodiment;

a scanner operatively associated with the coupling devices to scan one or more of the coupling devices to enable reception of a signal by the antenna by scanning the coupling devices; and a receiver operatively associated with the scanner to receive the signal from the coupling devices and to output a received signal.

Typically, the receiver includes a filter and amplifier connected to the antenna to filter and amplify the received signal a demodulator connected to the filter and amplifier for demodulating the received signal to provide an output information signal.

In accordance with an eleventh embodiment of the present invention there is disclosed a system for transmitting a scanned signal, the system comprising:

an antenna of the ninth embodiment;

a scanner operatively associated with a transmitter and with the coupling devices to provide a scanned curved signal in the first waveguide (in the case of the second embodiment a scanned cylindrical signal) whereby the signal transmitted by the antenna is a scanned signal.

Generally, the transmitter of the eleventh embodiment includes a microwave frequency generator, a modulator for mixing the microwave frequency with an input information signal to produce a modulated signal and a power amplifier for amplifying the modulated signal and outputting it to the scanner and then to the antenna of the ninth embodiment via the coupling devices.

In accordance with an twelfth embodiment of the present invention there is disclosed a system for scanning transmission and reception of an electromagnetic signal, the system comprising:

an antenna of the ninth embodiment;

a scanner operatively associated with the coupling devices to scan one or more of the coupling devices to enable reception of a signal by the antenna by scanning the coupling devices;

a receiver operatively associated with the scanner to receive a scanned signal from the coupling devices and to output a received signal; and wherein said scanner is operatively associated with a transmitter to provide a scanned curved signal in the first waveguide (in the case of the second embodiment a scanned cylindrical signal) whereby the signal transmitted by the antenna is a scanned signal.

Generally, in the system of the twelfth embodiment the scanner is coupled to a circulator, the circulator transferring energy received by the antenna to a filter, amplifier and receiver to provide an output information signal. The circulator also transfers energy from a microwave frequency generator, modulator and power amplifier to the antenna via the scanner for transmission of the modulated input information signal to free space.

In accordance with a thirteenth embodiment of the present invention there is disclosed a method of scanning receiving electromagnetic energy, the method comprising receiving electromagnetic energy with a system of the tenth embodiment.

In accordance with a fourteenth embodiment of the present invention there is disclosed a method of scanning transmitting electromagnetic energy, the method comprising the step of providing an information input signal to a transmitter of the system of the eleventh embodiment.

In accordance with a fifteenth embodiment of the present invention there is disclosed a method of scanning transmitting and scanning receiving electromagnetic energy, the method comprising the steps of:

providing an information input signal to a transmitter of the system of the twelfth embodiment; and receiving electromagnetic energy with the system of the twelfth embodiment.

Generally, the first and second parallel plate waveguides are disposed adjacent to one another in a sandwich type arrangement. This is achieved using a common single plate between each of the waveguides.

The antenna may be designed to operate at a frequency from 300 MHz–90 GHz, more typically 500 MHz–75 GHz and even more typically 1 GHz–60 GHz and yet even more typically in the microwave spectrum range. Antennae operating at 60 GHz or 1.5 GHz are of particular interest. An antenna operating at about 1.5 GHz is generally about 1 m in diameter and about 70 mm thick. The antenna can be made to operate outside this range if required by appropriately changing its overall dimensions.

Examples of preferred coupling devices are coaxially coupled top-loaded monopole and dielectrically headed monopole.

Generally the waveguide bend is a metal or metals which form a common substantially U-shaped or parabola-shaped wall or other shaped (generally curved shape) wall (the shape of the waveguide bend can be determined using the analysis technique described in G. T. Poulton and A. P. Whichello, I.R.E. Conf. International, Digest of Papers, 306–308, Sydney 5–9 Sep. 1983) at one end of the first and second cylindrical parallel plate waveguides with an aperture adjacent the common wall and communicating energy between each of the waveguides.

The metals from which the waveguides, parabolic bend and transmit/receive plate are fabricated are preferably copper, brass or aluminum.

The transmit/receive plate is typically a solid leaky dielectric or a metal plate with apertures.

It is preferred to fill the waveguides with a dielectric such as a doped foam.

BRIEF DESCRIPTION OF THE DRAWINGS

A preferred embodiment of the present invention will now be described with reference to the drawings in which.

BEST MODE AND OTHER MODES OF CARRYING OUT THE INVENTION

Figure 1:
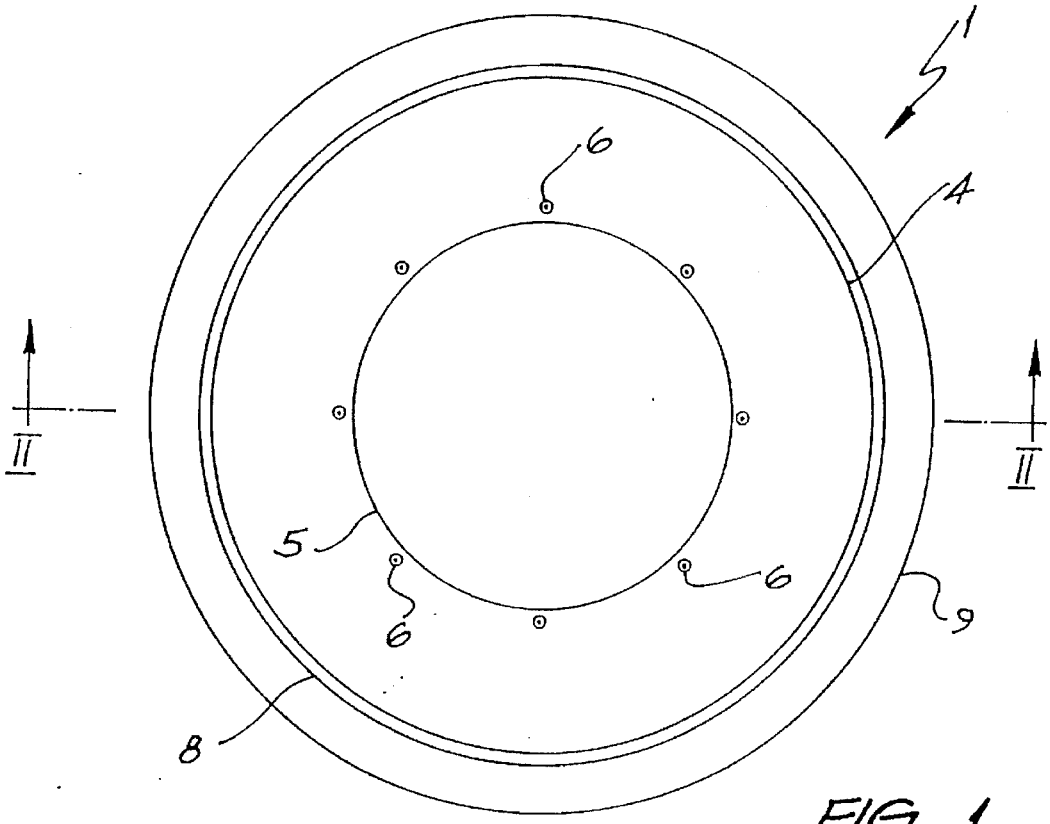
FIG. 1 illustrates a plan view of the folded lens antenna.
Figure 2:
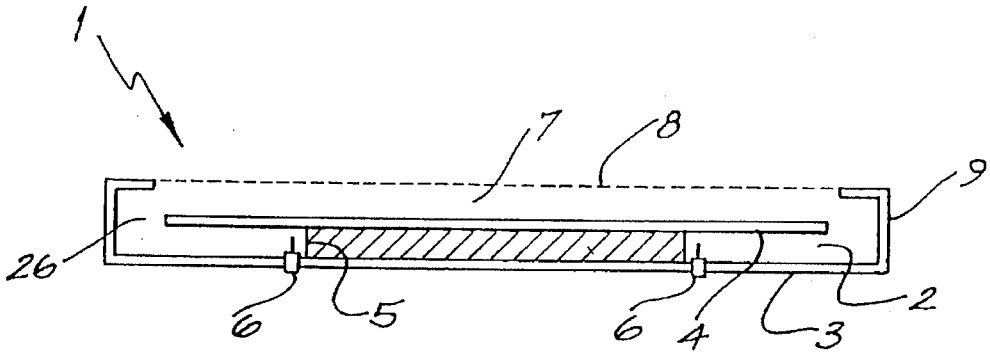
FIGS. 2 and 2*a* illustrate a vertical cross-section of section II—II of FIG. 1.
Figure 2A:
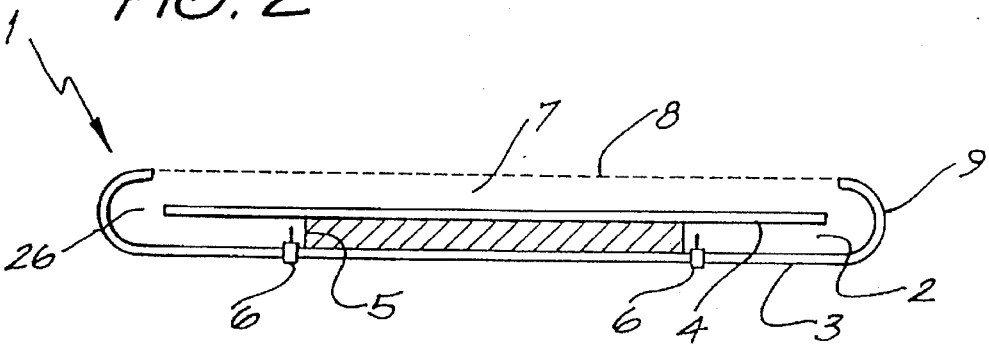

As seen in FIGS. 1, 2 and 2*a*, the folded lens antenna 1 comprises a cylindrical lower parallel waveguide 2 formed between a base plate 3 and a central plate 4. The cylindrical waveguide 2 has a centrally located reflector wall 5. Located adjacent to the wall 5 are a number of coupling devices or probes 6 adapted to couple energy from the waveguide 2 to electronics transmitting and/or receiving circuitry connected to the antenna 1. The antenna 1 also comprises a cylindrical upper parallel plate waveguide 7 formed between a leaky dielectric radiating plate 8 (such as a leaky dielectric plate or a metallic plate with apertures, for example) and the central plate 4.

Arranged at the periphery of each of the waveguides 2 and 7 is a waveguide bend 9 that transforms and communicates a cylindrical signal comprising a wave having a cylindrical wave front in the lower waveguide 2 into a planar signal comprising a wave with a planar wave front in the upper waveguide 7 and transforms and communicates a planar signal in the upper waveguide 7 into a cylindrical signal comprising a wave having a cylindrical wave front in the lower waveguide 2. The bend 9 is substantially U-shaped or parabolic-shaped (FIG. 2*a*) and has an aperture 26 that communicates between the ends of each of the waveguides 2 and 7. The dimensions pertinent to the bend 9 are devised by an electromagnetic field analysis to optimally transfer energy between waveguides 2 and 7. If such optimum dimensions are used then it can be shown that the laws of optics apply to the fields travelling from the input wave to the output wave (see G. T. Poulton and A. P. Whichello, I.R.E. Conference International, Digest of Papers, 306–308, Sydney 5–9 Sep. 1983). In particular, a cylindrical wave in waveguide 2 is optically transformed into a near plane wave in waveguide 7 by bend 9.

The two-layer parallel plate structure illustrated separates the function of azimuth scanning and radiation. The ring of probes 6 is located radially at or about half the radial dimension of the antenna 1, that is, at the pseudo-focus of the cylindrical lower waveguide 2. A single excited probe will thus radiate outwardly towards the rim where the parallel plate bend 9 transfers power to the upper waveguide 7 whilst simultaneously focusing in the azimuth plane. The radiating plate 8 of the lens antenna 1 is designed to leak power into free space with an appropriate polarization and elevation pattern, using slots in a metallic plate, or, printed radiators on a dielectric layer, or an appropriately designed dielectric layer.

Scanning of the beam formed by the antenna 1 is obtained by sequential switching of the probes 6 or by excitation in a particular phase relationship. Thus for scanning transmission of a signal from antenna 1 having six probes a, b, c, d, e and f, for example, three adjacent probes (say probes a, b and c) outputting an output signal in a given direction covering a segment of say 6° are excited initially. Then the beam is stepped by appropriate switching so as to excite the next three probes (say probes b, c and d) so as to output an output signal over the next 6°, and thereafter stepped again by appropriate switching so as to excite the next three probes (say probes c, d and e), so as to output an output signal over the next 6° and thereafter stepped again by appropriate switching so as to excite the next three probes (say probes d, e and f) and output an output signal over the next 6°. Similarly for eight probes a, b, c, d, e, f, g and h, for example, three adjacent probes (say probes a, b and c) outputting an output signal in a given direction covering a segment of say 6° are excited initially. Then the beam is stepped by appropriate switching so as to excite the next three probes (say probes b, c and d) so as to output an output signal over the next 6°, and thereafter stepped again by appropriate switching so as to excite the next three probes (say probes c, d and e), so as to output an output signal over the next 6° and thereafter stepped again by appropriate switching so as to excite the next three probes (say probes d, e and f) and output an output signal over the next 6° and thereafter stepped again by appropriate switching so as to excite the next three probes (say probes e, f and g) and output an output signal over the next 6° and thereafter stepped again by appropriate switching so as to excite the next three probes (say probes f, g and h) and output an output signal over the next 6°. In each of the above instances the scanning procedure may be repeated as many times as required. The scanning is typically initiated by exciting a group of probes so as to output a signal covering a segment forming one edge of the total beam and then scanned across to the other edge of the beam in a gradual manner by exciting sequentially adjacent groups of probes as outlined above. The switching between the groups of probes can be smoothed by slightly appropriately changing the relative amplitudes and phases of the excited probes. In other words, to enable the antenna 1 to scan smoothly, beam blending may be employed with individual beams having a crossover of approximately 3 dB. The number of probes in a group of probes may be chosen so as to achieve the desired result. Thus instead of the group of three probes as in the above described example, other groups such as one, two, four, five or six probes could be chosen for example. In addition, the number of probes excited in each group may be the same (e.g. 3 in each group as described in the above example) or different (e.g. 2 in one group followed by three in the next group followed by two in the next group etc.). With an assumed azimuth beam width of 45°, a total of 8 probes are required as shown in the embodiment illustrated in FIG. 1. Each of the waveguides 2 and 7 can be filled with a dielectric.

Figure 9:
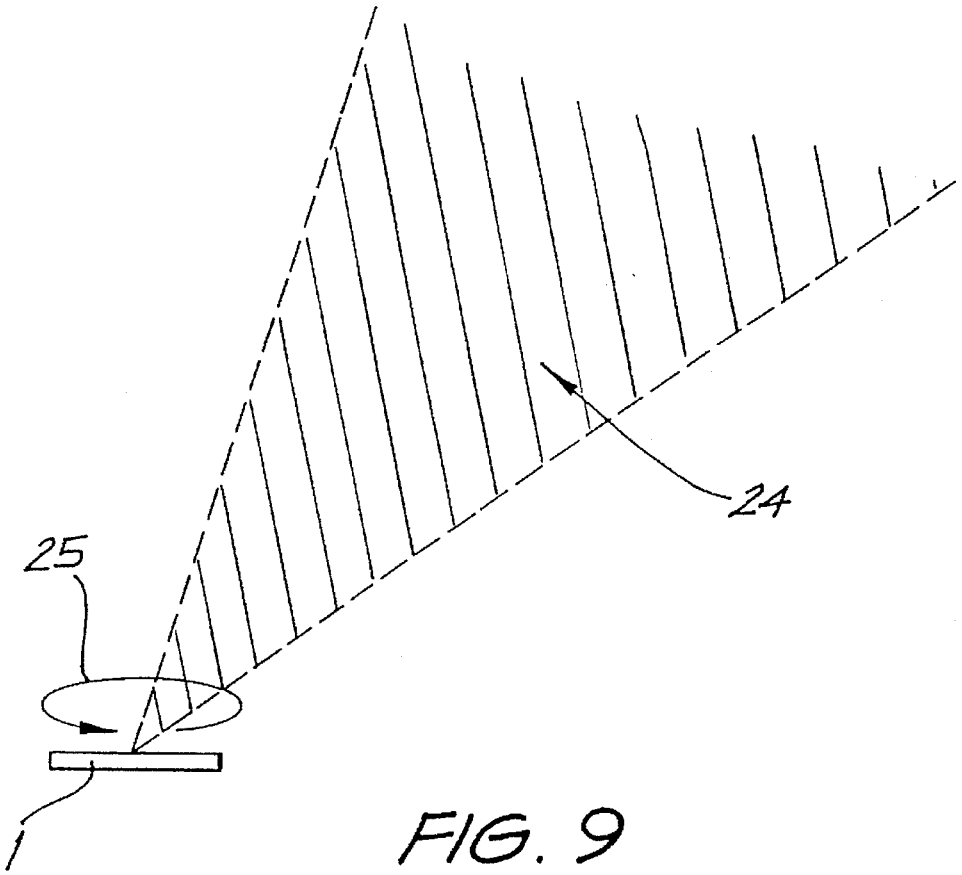
FIG. 9 illustrates the radiation pattern of the folded lens antenna.

FIG. 9 shows the radiation beam 24 and its circular scanning 25 of the antenna 1.

Figure 3:
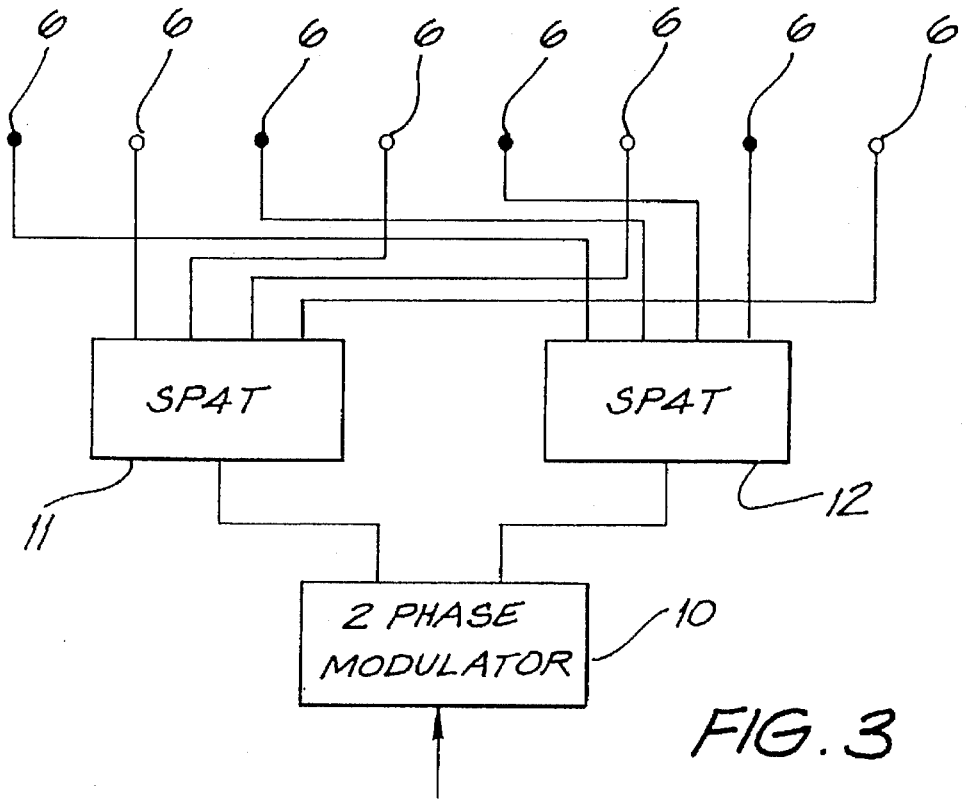
FIG. 3 shows a switching arrangement for coupling the probes.

As there are no stringent specifications placed upon beam ripple under scanning conditions, a simple two-phase modulator as illustrated in FIG. 3 is sufficient to feed the eight probes 6 of FIG. 1.

Illustrated in FIG. 3 is a modulation and switching arrangement for driving each of the probes 6. The arrangement comprises a two-phase modulator 10 and two single pole four throw switches 11 and 12 connected to the outputs of the modulator 10. This arrangement achieves switching of any two adjacent probes to an active state to enable transmission and/or reception. It will be understood by those skilled in the art that at any one time, only two adjacent probes 6 are excited at any one point in time.

Figure 4:
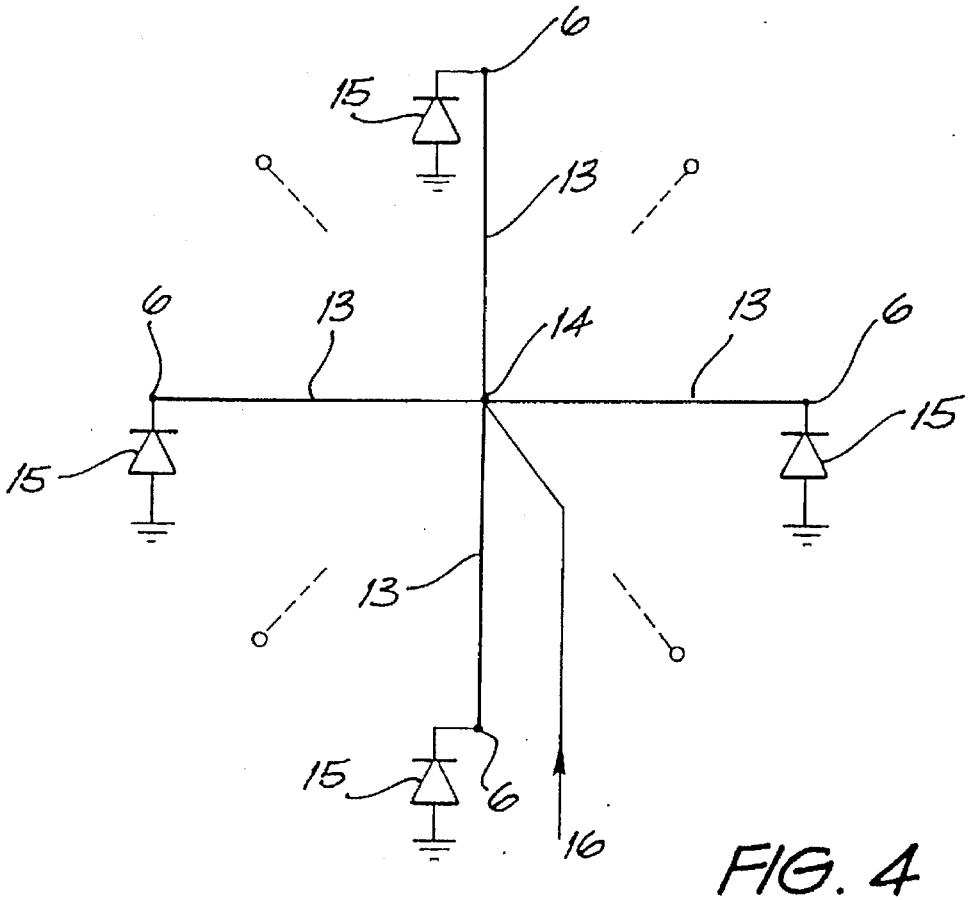
FIG. 4 shows one form of the single pole four throw switch of FIG. 3.

As side lobe specifications are not stringent, isolation requirements for each of the switches 11 and 12 can be relaxed. This provides an opportunity to make use of a very simple switching arrangement in order to reduce cost. Such an arrangement is illustrated in FIG. 4. FIG. 4 illustrates a simple single pole four throw switch of FIG. 3 and comprises four quarter-wave feedlines 13 radiating from a central junction 14. At the end of each feed line 13 is a diode 15 having its cathode connected to earth. A probe 6 is linked between junction 14 and each diode 15.

Three of the diodes, when conducting, present a high impedance at the junction 14 and, as such, all power from the input 16 is transferred to the fourth diode, which is off.

It may be necessary to site each of the diodes 15 at the minimum scattering plane of the probes 6, rather than as shown in FIG. 4, in order to minimise the effects of the shorted probes on the radiation pattern emanating from all received by the antenna 1.

The probes 6 are scanned to maintain radiated beam locked onto the transmitting satellite. This may be achieved by any of several well-known methods, e.g. monopulse or beam nodding. The latter method, involving low frequency modulation of the beam pointing direction, is the preferred option.

Figure 5:
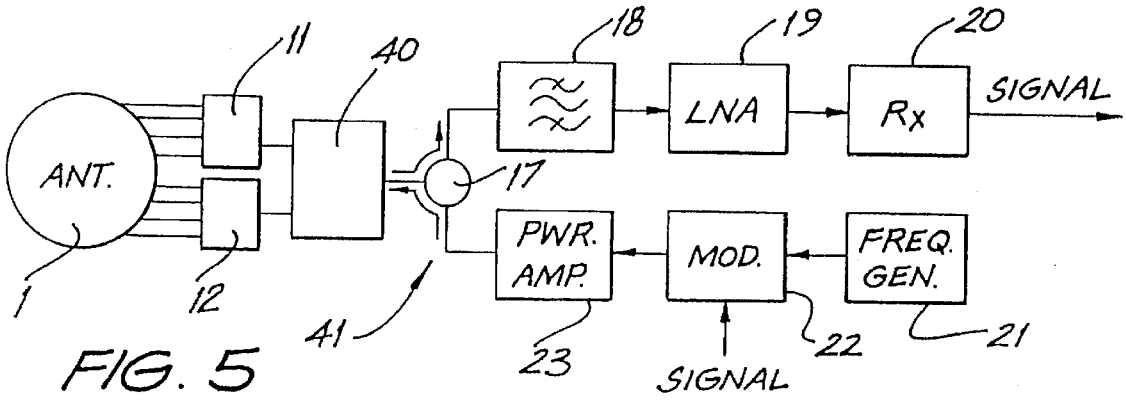
FIG. 5 shows a preferred transceiver system.

Illustrated in FIG. 5 is a preferred transceiver system 41. The system comprises the antenna 1 coupled to SP4T switches 11 and 12 as previously described. The switches 11 and 12 are coupled to a modulator/demodulator 40 which feed signals to and from the antenna. The modulator 40 is coupled to a circulator 17 that directs signals to and from a receiver section and a transmitter section. On reception, signals are coupled by the circulator 17 to a bandpass filter 18. The receive signal is then amplified by low noise amplifier 19 and demodulated by receiver 20. The receiver 20 outputs an information signal to any output device. On transmission, a frequency generator 21 creates a microwave frequency which is inputted to a modulator 22. The modulator 22 mixes the microwave frequency with an input information signal to produce a modulated signal. The modulated signal is amplified by power amplifier 23 which is then coupled, via the circulator 17 and other components as earlier described, to the antenna 1. The transceiver system 41 would be typically used in mobile satellite telephone circuits, for example.

Figure 6:
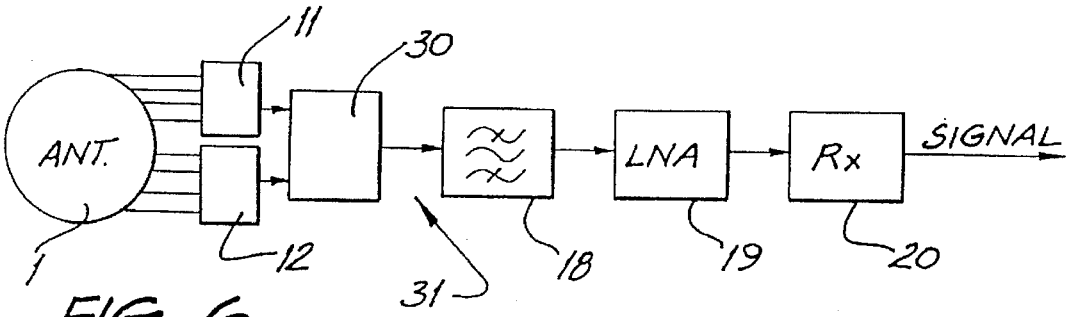
FIG. 6 shows a preferred receiver system.

FIG. 6 illustrates a scanning receiver system that could be used for reception of radio, or television transmissions on a mobile platform. In this embodiment, a demodulator 30 is coupled to the switches 11 and 12 and drives the bandpass filter 18 in the manner as previously described.

Figure 7:
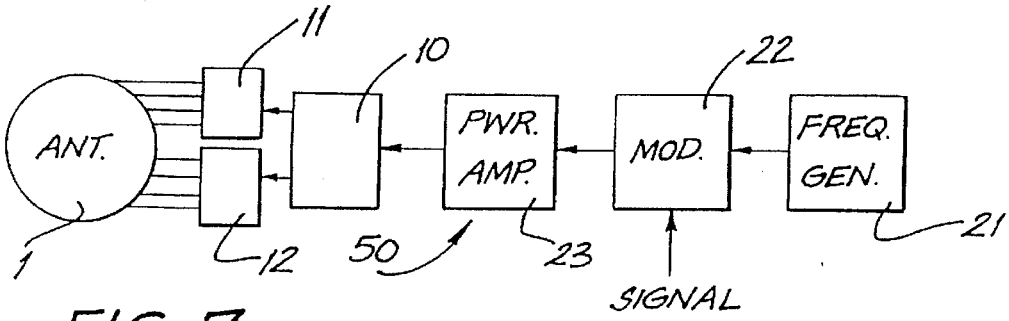
FIG. 7 shows a preferred transmitter system.

FIG. 7 illustrates an embodiment dedicated to the scanning transmission of an information signal. This application would be most suitable for satellite ground stations.

Figure 8:
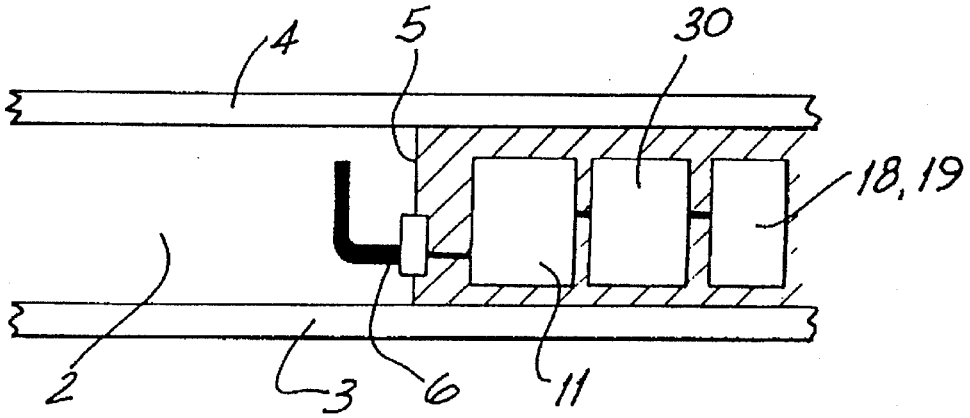
FIG. 8 illustrates an alternative arrangement of the probes.

Illustrated in FIG. 8 is an alternative arrangement of the probe 6. As seen in FIG. 8, the probe 6 is coupled into the lower waveguide 2 through the wall 5. The probe 6 is substantially vertical within the waveguide 2 in order to create the appropriate waveform for transmission. As also seen in FIG. 8, the space provided behind the wall 5 is a convenient location for the switches 11 and 12 (11 only being illustrated) demodulator 30, and the bandpass filter and low noise amplifier 18 and 19 respectively. It is known by those skilled in the art that it is advantageous to locate input circuitry of a receiver system as close as possible to the antenna and thus the space provided behind the wall 5 provides an excellent opportunity for this to be achieved.

Industrial Applicability

The folded lens antenna of the present invention (particularly the folded lens antenna of the second embodiment) is especially useful in mobile satellite communication systems.

The foregoing describes only one embodiment of the present invention and other embodiments, obvious to those skilled in the art, can be made thereto without departing from the scope of the present invention.

I claim:

1. A folded lens transmit/receive antenna comprising:

a first curved parallel plate waveguide;

a second curved parallel plate waveguide;

waveguide coupling means operatively associated with the first and second waveguides for communicating a signal therebetween as to transform a signal comprising a wave having a substantially curved wave front from the first waveguide to a signal comprising a wave having a substantially planar wave front in the second waveguide;

free space coupling means for coupling a signal between the second waveguide and free space, the free space coupling means being operatively associated with the second parallel plate waveguide; and plurality of coupling devices arranged about a curved reflector disposed in the first waveguide for coupling a signal between the first waveguide and transmit/receive apparatus connectable to said coupling devices to enable scanning of an antenna radiation pattern.

2. The folded lens transmit/receive antenna of claim 1 wherein:

the first curved parallel plate waveguide is a cylindrical parallel plate waveguide;

the second curved parallel plate waveguide is a cylindrical parallel plate waveguide;

the reflector is a cylindrical reflector centrally disposed in the first cylindrical parallel plate waveguide; and the waveguide coupling means is operatively associated with the first and second waveguides to communicate a signal therebetween so as to transform a cylindrical signal comprising a wave having a cylindrical wave front from the first waveguide to a planar signal comprising a wave having a planar wave front in the second waveguide.

3. The folded lens transmit/receive antenna of claim 2, wherein the waveguide coupling means comprises a waveguide bend disposed about the peripheries of the first and second waveguides.

4. The folded lens transmit/receive antenna of claim 2 wherein the means for coupling is selected from the group consisting of a transmit/receive plate comprising at least one plate of the second waveguide, a single aperture in one of the parallel plates of the second waveguide and a plurality of apertures in one of the parallel plates of the second waveguide.

5. The folded lens transmit/receive antenna of claim 2 usable for receiving a signal and outputting a received signal, including:

a receiver operatively associated with the coupling device of the antenna for receiving the received signal.

6. The system of claim 5 wherein the receiver comprises a filter and amplifier operatively associated with the antenna to filter and amplify the received signal and a demodulator operatively associated with the filter and the amplifier for demodulating the received signal to provide an output information signal.

7. The folded lens transmit/receive antenna of claim 2 usable for transmitting an electromagnetic signal including:

a transmitter operatively associated with the coupling device to generate a cylindrical signal in the first waveguide.

8. The system of claim 7 wherein the transmitter comprises a microwave frequency generator, a modulator operatively associated with the generator for mixing the microwave frequency with an input information signal to produce a modulated signal and a power amplifier operatively associated with the modulator for amplifying the modulated signal and outputting it to the transmit/receive antenna for transmission of the modulation signal to free space.

9. A system for transmitting and receiving electromagnetic energy, said system comprising:

a folded lens transmit/receive antenna of claim 2 for receiving and transmitting an electromagnetic signal and outputting a received signal;

a receiver operatively associated with the coupling device; and a transmitter operatively associated with the coupling device to generate a cylindrical signal in the first waveguide.

10. The system of claim 9 wherein the antenna is operatively associated with a circulator coupled to an output means, the circulator being capable of transferring energy received by the antenna to the output means, the output means providing an output information signal.

11. The system of claim 10 wherein the circulator is operatively associated with a modulated signal input means to enable transfer of a modulated input information signal from the input means to the antenna for transmission of the signal to free space.

12. An antenna as in claim 1 including:

a scanner operatively associated with the probes to scan one or more of the coupling devices to enable reception of a signal by the antenna by scanning the coupling devices; and a receiver operatively associated with the scanner to receive the signal from the coupling devices and to output a received signal.

13. The antenna of claim 12 wherein the receiver includes means to filter and amplify the received signal and a demodulator operatively associated with the means, to demodulate the received signal to provide an output information signal.

14. An antenna as in claim 1 including:

a scanner operatively associated with a transmitter and with the coupling devices to provide a scanned cylindrical signal in the first waveguide whereby the signal transmitted by the antenna is a scanned signal.

15. An antenna as in claim 1 including:

a scanner operatively associated with the coupling devices to scan one or more of the coupling devices to enable reception of a signal by the antenna by scanning the coupling devices;

a receiver operatively associated with the scanner to receive a scanned signal from the coupling devices and to output a received signal; and wherein said scanner is operatively associated with a transmitter to provide a scanned cylindrical signal in the first waveguide whereby the signal transmitted by the antenna is a scanned signal.

16. The antenna of claim 2 wherein the first and second cylindrical parallel plate waveguides are disposed adjacent to one another in a sandwich type arrangement.

17. The antenna of any one of claims 1 to 4 wherein the antenna is capable of operating at a frequencies in the range of form 300 MHz–90 GHz.

18. The system of any one of claims 5 to 11, 12 to 16 wherein the system is capable of operating at a frequencies in the range of from 300 MHz–90 GHz.

19. The folded lens transmit/receive antenna of claim 3 wherein said waveguide bend has a shape selected from a group including a parabolic shape and a U-shape.

20. The folded lens transmit/receive antenna of claim 5 wherein said waveguide coupler has a shape selected from a group including a parabolic shape and a U-shape.

* * * * *